US010618771B2

(12) United States Patent
Joyner

(10) Patent No.: US 10,618,771 B2
(45) **Date of Patent: *Apr. 14, 2020**

(54) RETRACTABLE STRAP

(71) Applicant: William F. Joyner, North Wilkesboro, NC (US)

(72) Inventor: William F. Joyner, North Wilkesboro, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/293,322

(22) Filed: Mar. 5, 2019

(65) Prior Publication Data

US 2019/0193985 A1 Jun. 27, 2019

Related U.S. Application Data

(62) Division of application No. 15/630,504, filed on Jun. 22, 2017, now Pat. No. 10,233,052.
(Continued)

(51) Int. Cl.
*B65H 75/48* (2006.01)
*A45C 13/26* (2006.01)
(Continued)

(52) U.S. Cl.
CPC ..... *B65H 75/486* (2013.01); *A45C 1/02* (2013.01); *A45C 3/02* (2013.01); *A45C 11/00* (2013.01); *A45C 13/10* (2013.01); *A45C 13/26* (2013.01); *A45C 13/30* (2013.01); *A45F 3/02* (2013.01); *A45F 3/04* (2013.01); *A45F 3/14* (2013.01); *B65H 75/4431* (2013.01); *B65H 75/4439* (2013.01); *B65H 75/4442* (2013.01);
(Continued)

(58) Field of Classification Search
CPC .... B65H 75/40; B65H 75/48; B65H 75/4423; B65H 75/4431; B65H 75/486; B65H 75/4439; B65H 75/4442; B65H 74/48; B65H 2701/37; A45C 3/00; A45C 3/02; A45C 3/06; A45C 3/0059; A45C 13/30; A45C 5/00; A45C 1/02; A45C 11/00; A45C 13/10; A45C 13/26; A45C 2011/003; A45F 3/02; A45F 3/047; A45F 2003/142; A45F 5/004; A45F 3/14; Y10S 224/93; B66D 3/04; B66D 5/34; Y10T 24/2147
USPC ..... 224/164, 258; 254/364, 380, 376
See application file for complete search history.

(56) References Cited

U.S. PATENT DOCUMENTS 2,769,475 A 11/1956 Fisher
3,198,300 A 8/1965 Tuttle
(Continued)

*Primary Examiner* — Jack W Lavinder
(74) *Attorney, Agent, or Firm* — Shumaker, Loop & Kendrick, LLP

(57) ABSTRACT

A strap may be removably attachable to a container. The strap may include a retractor having an opening, a retraction spring and a brake. The strap may further include a strip of flexible material attached to the retraction spring and extending through the opening of the retractor. The strap may also include clips attaching the retractor and distal end of the flexible material to the container. The strip of flexible material may move from a fully retracted position, where the distal end of the strip of flexible material is nearest the retractor, relative to the entire length of the strip of flexible material, to an extended position where the distal end of the strip of flexible material is furthest from the retractor. The retraction spring may bias the strip of flexible material into/toward the fully retracted position.

6 Claims, 14 Drawing Sheets

Related U.S. Application Data

(60) Provisional application No. 62/353,655, filed on Jun. 23, 2016.

(51) Int. Cl.

| | |
|---|---|
| ***A45F 3/14*** | (2006.01) |
| ***A45C 13/10*** | (2006.01) |
| ***A45C 1/02*** | (2006.01) |
| ***A45C 3/02*** | (2006.01) |
| ***A45C 11/00*** | (2006.01) |
| ***A45F 3/04*** | (2006.01) |
| ***B65H 75/44*** | (2006.01) |
| ***A45C 13/30*** | (2006.01) |
| ***A45F 3/02*** | (2006.01) |

(52) U.S. Cl.
CPC ..... *B65H 75/48* (2013.01); *A45C 2011/003* (2013.01); *A45F 2003/142* (2013.01); *B65H 2701/37* (2013.01)

(56) References Cited

U.S. PATENT DOCUMENTS

| | | | | |
|---|---|---|---|---|
| 3,528,645 | A * | 9/1970 | Harken | B66D 3/04 254/412 |
| 5,027,874 | A | 7/1991 | Gazzola | |
| 5,072,867 | A | 12/1991 | Zingale | |
| 5,294,029 | A | 3/1994 | Shimura et al. | |
| 5,897,039 | A | 4/1999 | Swenke | |
| 6,053,381 | A | 4/2000 | Fahl et al. | |
| 7,575,224 | B1 * | 8/2009 | Madland | B66D 3/04 24/71 ST |
| 8,123,092 | B2 | 2/2012 | Krulik | |
| 8,708,206 | B2 * | 4/2014 | Onessimo | A45F 3/04 224/576 |
| 2003/0010861 | A1 | 1/2003 | Tsan | |
| 2007/0170295 | A1 | 7/2007 | Breeden | |
| 2009/0212082 | A1 | 8/2009 | Bautista et al. | |
| 2010/0016132 | A1 * | 1/2010 | Flynn | A63B 21/0004 482/122 |

* cited by examiner

FIG. 5
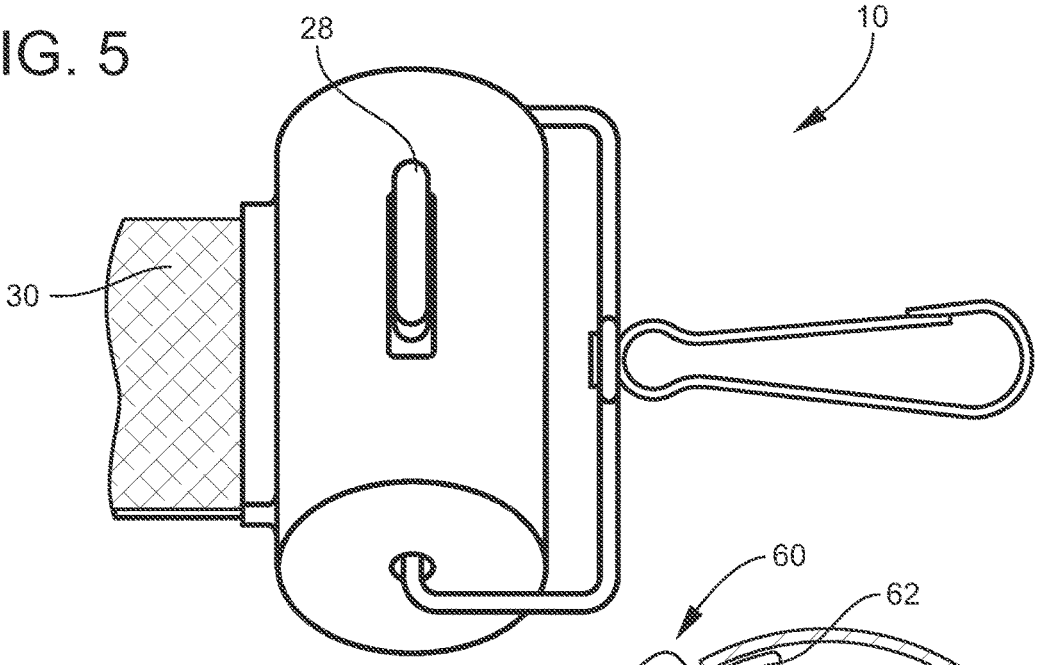
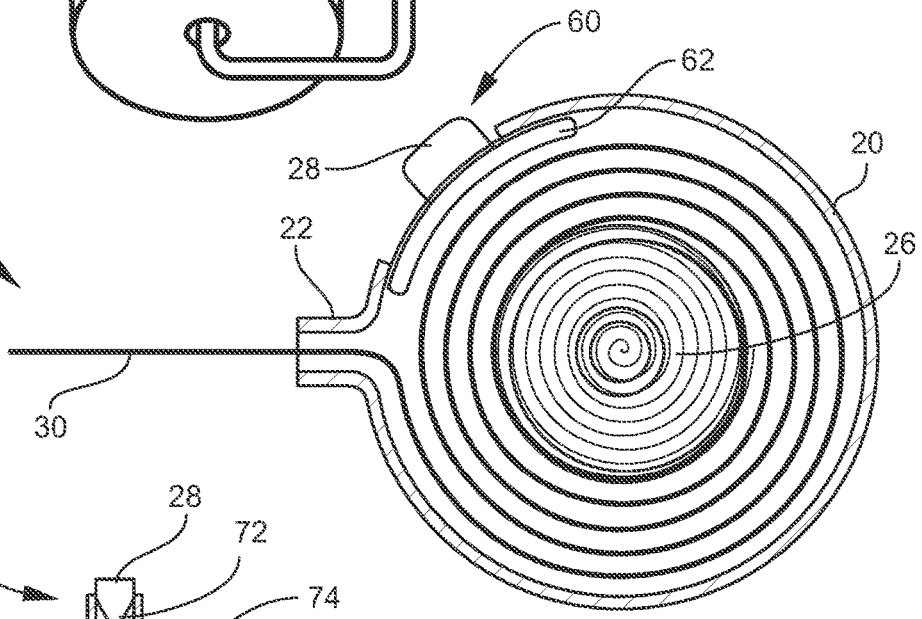
FIG. 6
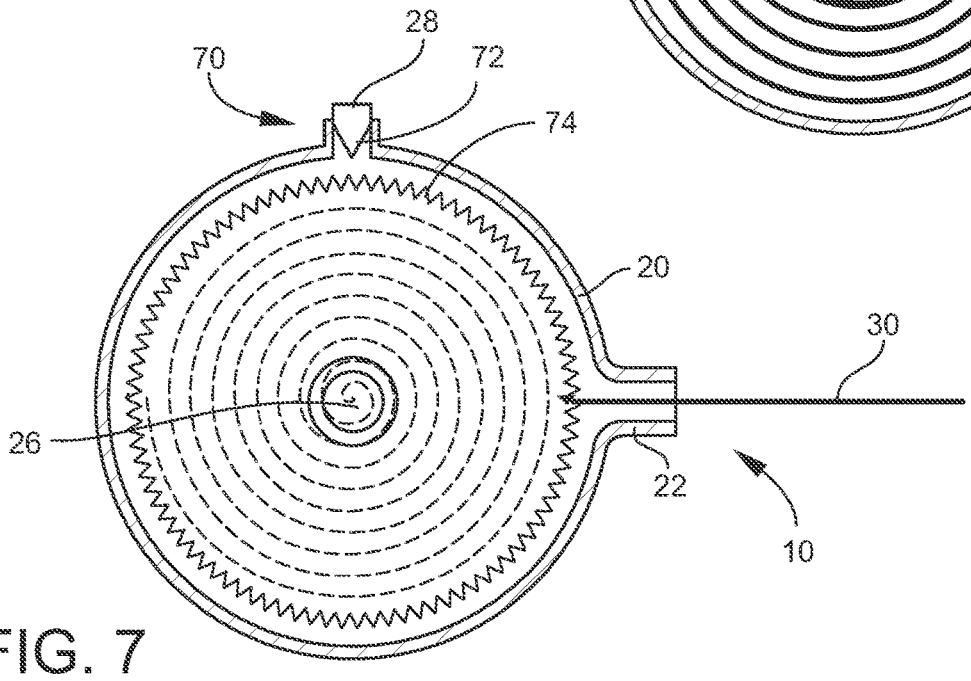
FIG. 7

RETRACTABLE STRAP

CROSS-REFERENCE TO RELATED APPLICATIONS

This is a Divisional application claiming priority to U.S. patent application Ser. No. 15/630,504, filed on Jun. 22, 2017, and U.S. Provisional Application No. 62/353,655, filed on Jun. 23, 2016, the entire contents of each are hereby incorporated by reference in the entirety.

TECHNICAL FIELD AND BACKGROUND OF THE INVENTION

The invention relates generally to the field of materials handling and more particularly, to the field of mechanical aids for transporting containers.

Humans have long utilized containers to move objects from one place to another. Such containers may be large or small and may house precious cargo, refuse, and anything in between. For personal travel, humans often carry luggage such as suitcases, travel bags, briefcases, trunks, bottles, and the like. They may utilize specialized cases for transporting musical instruments, electronic equipment, and even liquids. Some containers may have wheels. Others may be designed to be carried in the hand or on one or more shoulders. For each of these personal travel types of containers, it is desirable to have a handle, strap, or other means of manipulating the container.

Many such handles are rigid and immovably attached to the container. Straps are typically less rigid or even loose and may be fixed or removable from the container. Non-rigid straps and handles are beneficial in many respects but, when not in use, are prone to tangling and otherwise obstructing the area around the container. For instance, where a briefcase having a strap is tossed into a car as the driver gets in, that strap can often snag on a hand brake or gearshift lever when the person attempts to leave the vehicle and take the briefcase along. When such a case has been placed under an airplane seat, the loose strap may become entangled with seat components, or may cause a passenger to trip and possibly fall. Similarly, even the straps on a backpack create a trip hazard when placed on the floor of a classroom. As another example, the strap on a purse or pocketbook may become lodged in the closing doors of an automobile or subway car and cause injury. Accordingly, there exists a need in the art for a strap for a container which minimizes the potential for damage, inconvenience, and injury caused by loose straps. There is also a need in the art for a strap which may be removably attachable to many different containers.

SUMMARY OF THE INVENTION

It is therefore an object of the present invention to provide a retractable strap for carrying a container which is removably attachable to the container. It is an object of the present invention that the strap be optionally loose for carrying and taut for storage. It is another object of the invention to provide a strap which is fully retractable and may be extended as desired by a user. It is another object of the invention that the strap be attachable at two different points to a container and that it is taut when attached at each point and retracted.

These and other objects and advantages of the invention are achieved by providing a strap which is removably attachable to a container and includes a retractor. The retractor may have an opening and a retraction spring. Optionally, the retractor may have a brake. The strap may also have a strip of flexible material attached to the retraction spring and extending through the opening of the retractor. The strap may also have a clip attaching a distal end of the flexible material to the container. The strip of flexible material may move from a fully retracted position where the distal end of the strip of flexible material is nearest the retractor relative to the entire length of the strip of flexible material, to an extended position where the distal end of the strip of flexible material is furthest from the retractor. The retraction spring may bias the strip of flexible material into/toward the fully retracted position.

According to one embodiment of the invention, the strip of flexible material and the retraction spring may be attached to an axle. The flexible material may wrap around the axle. The axle may extend through the body of the retractor.

According to another embodiment of the invention, the clip may be a swivel clip having a clip portion mounted in a yoke portion. The clip portion of the swivel clip is able to rotate about a central axis within the yoke.

According to another embodiment of the invention, the strap may include a second clip for attaching the retractor to the container. The second clip may be a swivel clip having a clip portion mounted in a yoke portion. The clip portion of the second swivel clip is able to rotate about a central axis within the yoke.

According to another embodiment of the invention, the clip and the second clip are designed to support a load of at least 50 pounds each.

According to another embodiment of the invention, the yoke of the second swivel clip may be connected to the axle.

According to another embodiment of the invention, the brake may be used to prevent retraction of the strip of flexible material.

According to another embodiment of the invention, the brake may be used to adjust the length of the strip of flexible material.

According to another embodiment of the invention, the brake may be a friction brake. The friction brake may apply a force on the strip of flexible material to prevent extension or retraction of the strap.

According to another embodiment of the invention, the brake may be a ratchet brake. According to another embodiment of the invention, the strap may further include a buckle, with which the effective length of the strap may be adjusted.

According to another embodiment of the invention, that strap may be removably attachable to a briefcase, a laptop case, an instrument case, an equipment bag, a suitcase, a garment bag, a trunk, a duffel bag, a backpack, a diaper bag, a purse, a pocketbook, a liquid container, and the like.

According to another embodiment of the invention, the strap also may feature a sliding shoulder pad that can be positioned according to the needs of the user, whether the strip of flexible material is extended or retracted. The shoulder pad may be in sliding relation to the strip of flexible material.

According to another embodiment, a retractable strap may be removably attachable to a container and may include an upper shell attached to a base, a plurality of attachment points connecting the upper shell to the base, a pair of axle supports attached to the base, an axle rotatingly attached to each of the axle supports and spanning the distance between the axle supports, a strip of flexible material attached to the axle, having a width less than the distance between the axle supports, and extending through an opening in the upper shell, a pair of springs attached to the base and to the axle for biasing the retractable strap in a retracted position, a first D ring attached to the base and held in place by the upper shell, a first clip attached to the first D ring and also attached to the container, a second D ring attached to a distal end of the strip of flexible material, a second clip attached to the second D ring and also attached to the container, and a buckle attached to the strip of flexible material and disposed between the opening of the upper shell and the second D ring. The retractable strap may operate from the retracted position where the distal end of the strip of flexible material is nearest the upper shell relative an entire length of the strip of flexible material to an extended position where the distal end of the strip of flexible material is furthest from the upper shell.

According to another embodiment, the container may be one or more of a briefcase, a laptop case, an instrument case, an equipment bag, a suitcase, a garment bag, a trunk, a duffel bag, a backpack, a diaper bag, a purse, a pocketbook, a liquid container, and the like.

BRIEF DESCRIPTION OF THE DRAWING FIGURES

The present invention is best understood when the following detailed description of the invention is read with reference to the accompanying drawings, in which:

FIG. 5 is a perspective view of an embodiment of the invention showing the locking mechanism;

FIG. 6 is a cutaway view of an embodiment of the retractor showing a friction locking mechanism; and FIG. 7 is a cutaway view of an embodiment of the retractor showing a ratchet locking mechanism.

DETAILED DESCRIPTION OF THE PREFERRED EMBODIMENT

Figure 1:
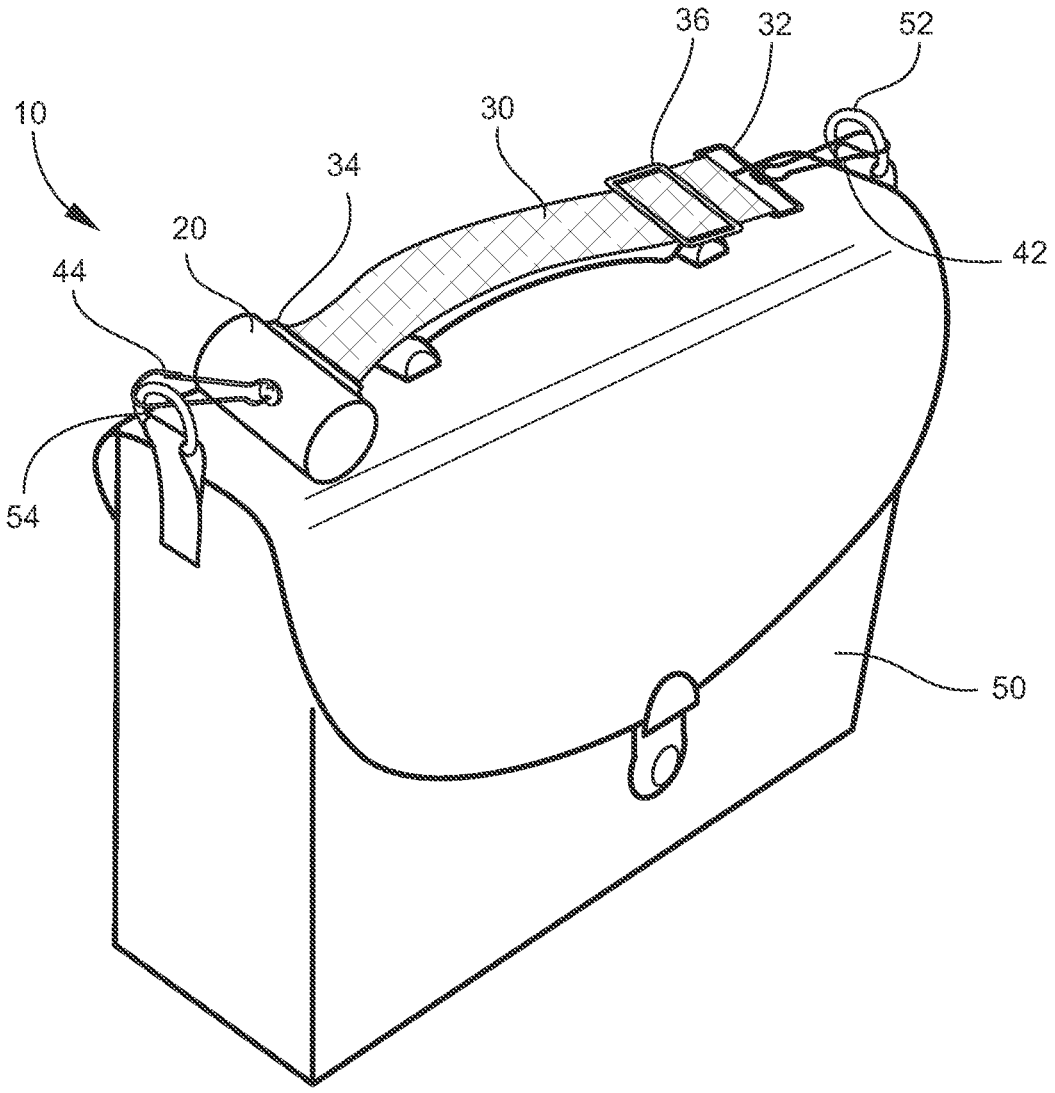
FIG. 1 is a perspective view of an embodiment of the invention installed on a piece of luggage with the strap in a taut, retracted position.

Referring now to the drawings, FIGS. 1, 2, 3, and 9 show a retractable strap 10 removably attached to a piece of luggage 50 such as a briefcase. The retractable strap 10 is external to the piece of luggage 50 and may be fully detached, partially detached, and reattached at the option of a user.

Figure 2:
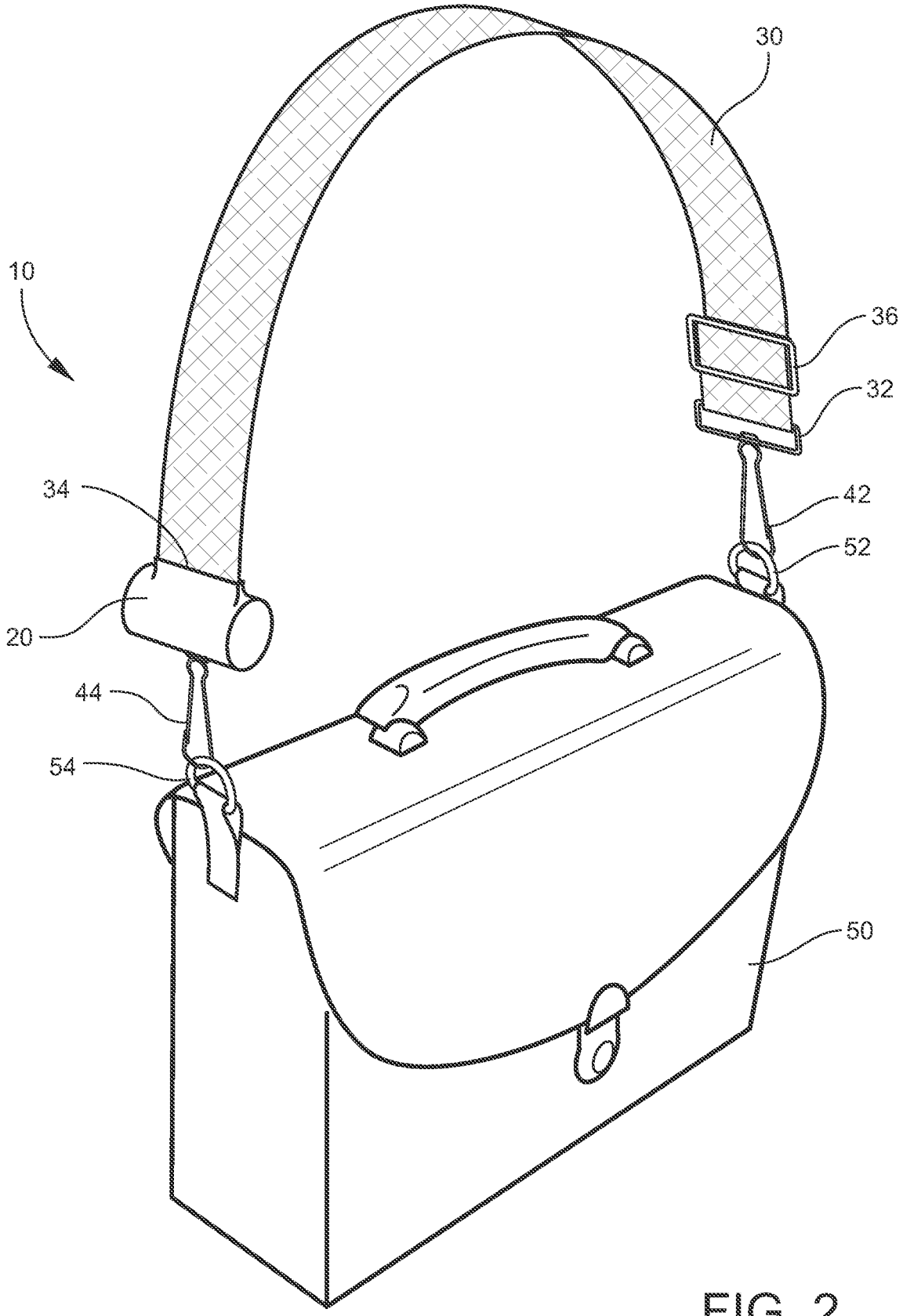
FIG. 2 is a perspective view of an embodiment of the invention installed on a piece of luggage with the strap in an extended position.
Figure 3:
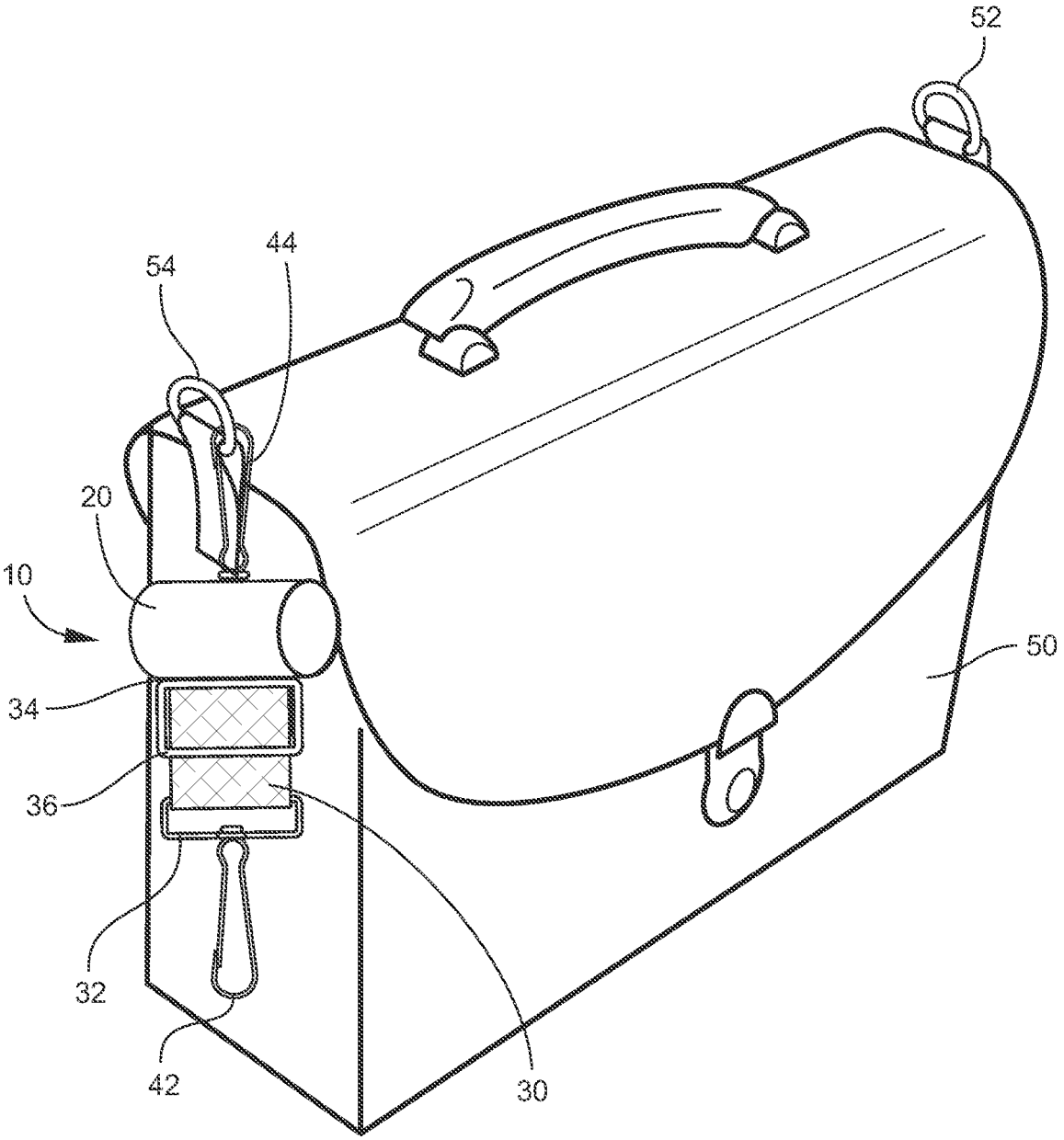
FIG. 3 is a perspective view of an embodiment of the invention installed on a piece of luggage with the strap in a retracted position.
Figure 8:
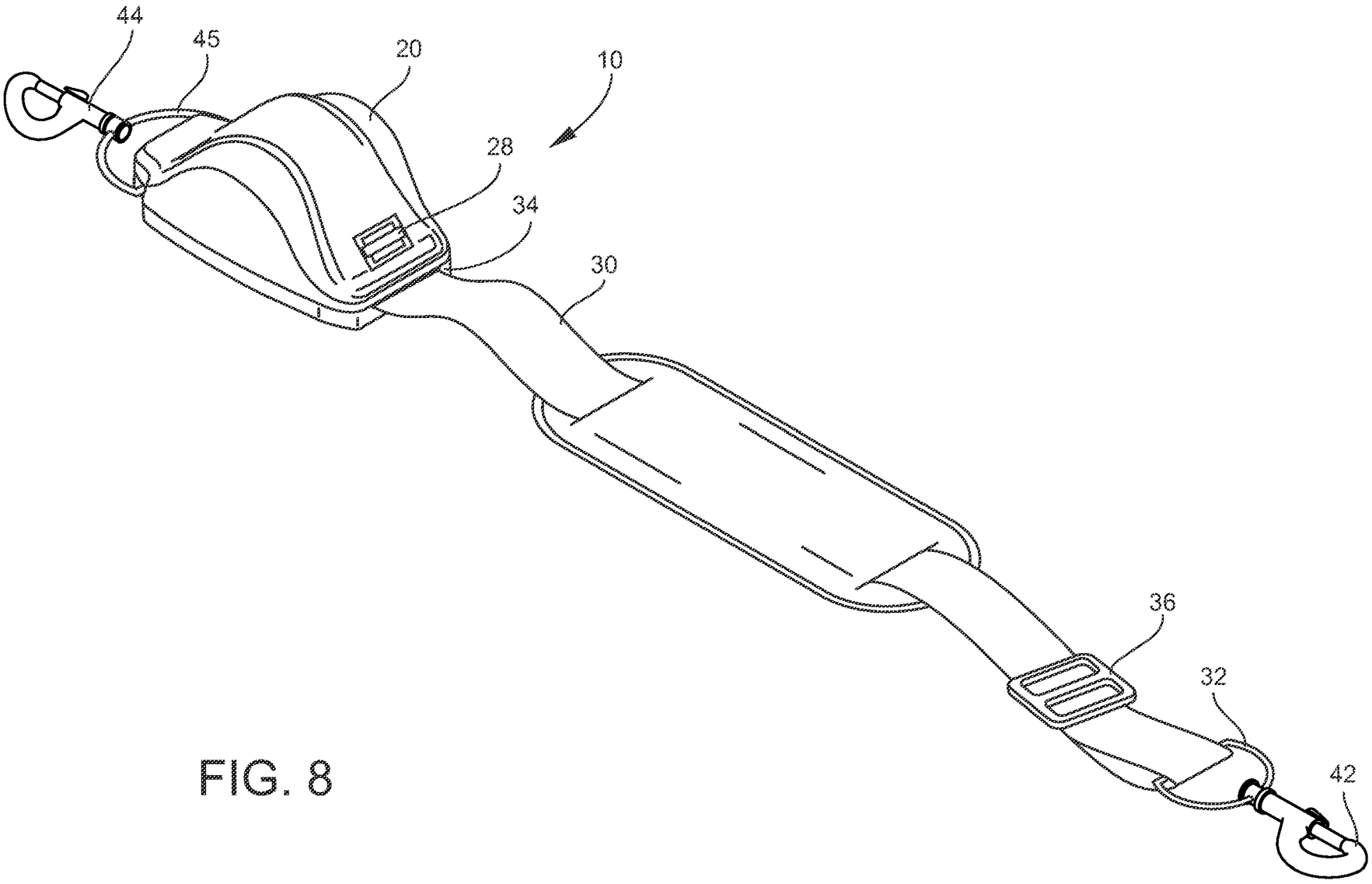
FIG. 8 is a perspective view of an embodiment of the retractor and strap.
Figure 9:
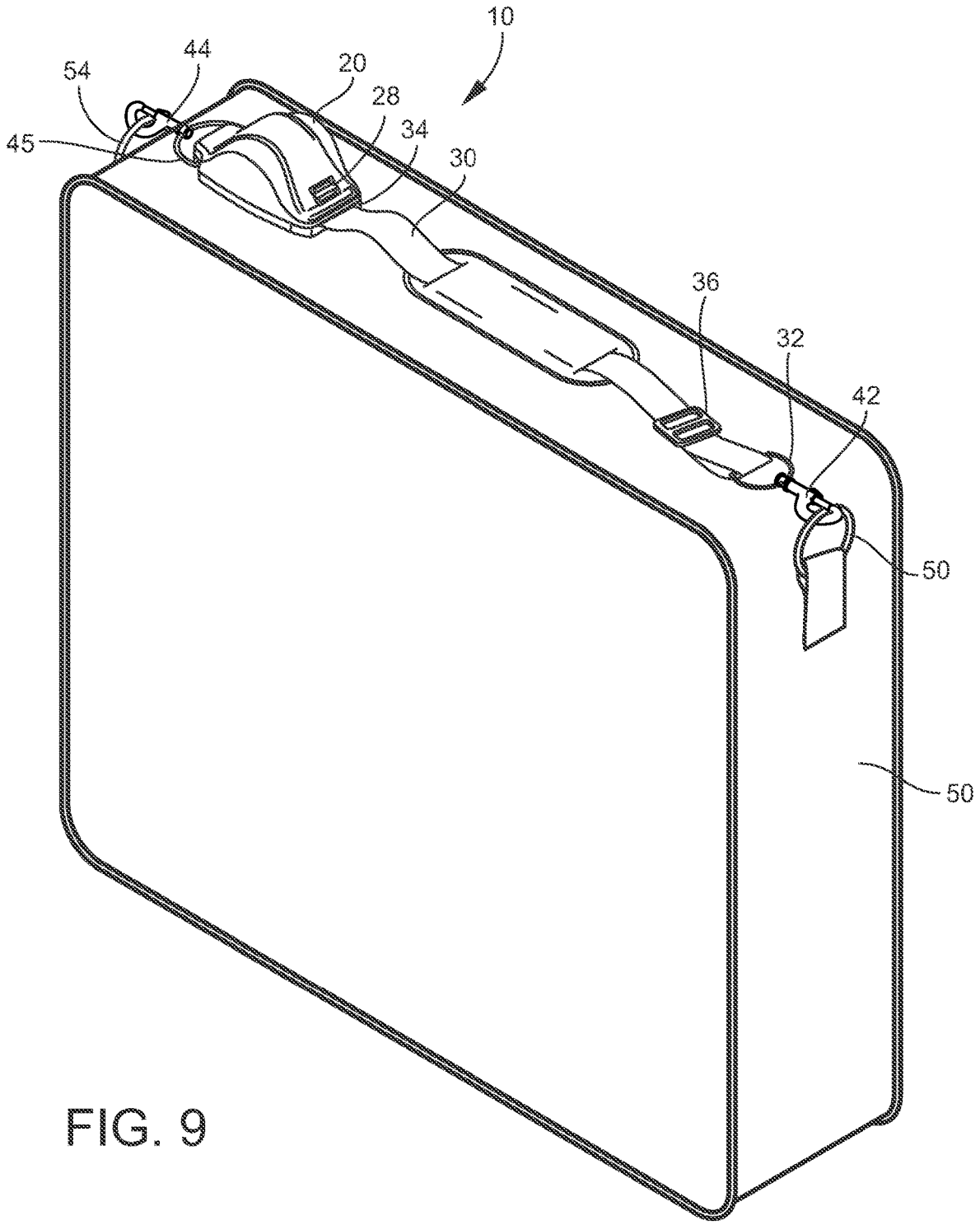
FIG. 9 is a perspective view of an embodiment of the retractor and strap attached to a piece of luggage.

The retractable strap has a retractor 20 which houses retracted portions of the strap 30. Unretracted portions of the strap 30 extend from the retractor 20 at point 34, the point at which the strap becomes visible. The retractor 20 biases the strap into/toward a retracted position as shown in FIG. 3. The unretracted length of the strap 30 may be adjusted by pulling retracted portions of the strap 30 from the retractor 20 as shown in FIG. 2, and locking it into place with the lock 28 shown in FIGS. 5, 6, 8, and 9. Additionally, the unretracted length may be adjusted by manipulating buckle 36 which slides along the length of the strap 30 from end retainer 32. End retainer 32 may have a "D" shape as shown in FIGS. 8 and 9.

The retractor 20 may be attached to an attachment point 54 on the luggage 50 via a clip 44. As shown in FIGS. 8 and 9, additional "D" shaped ring 45 may link the clip 44 to the retractor 20. Similarly, the distal end of the strap may also be attached to the luggage 50 via a clip 42 which is attached to end retainer 32. By design, the clips 42 and 44 are designed to attach the removable strap 10 to many different types of luggage 50. The luggage 50 may be a briefcase, a laptop case, an instrument case, an equipment bag, a suitcase, a garment bag, a trunk, a duffel bag, a backpack, a diaper bag, a purse, a pocketbook, a liquid container, and the like without restriction. In the case of the backpack, there may be two straps 30, one for each shoulder of a user.

The strap 30 may be made of a manmade or a natural material and may be woven or non-woven. Such materials may include: nylon, cotton, wool, bamboo, silk, polyester, plastic, rayon, acrylic, and metal, among others. Further, the strap 30 may comprise a combination of different materials such as a cotton-polyester blend. The retractor 20 may be made from metal, nylon, plastic, wood and/or other materials. Preferably, the strap 30 and the retractor 20 have a light weight.

Figure 4:
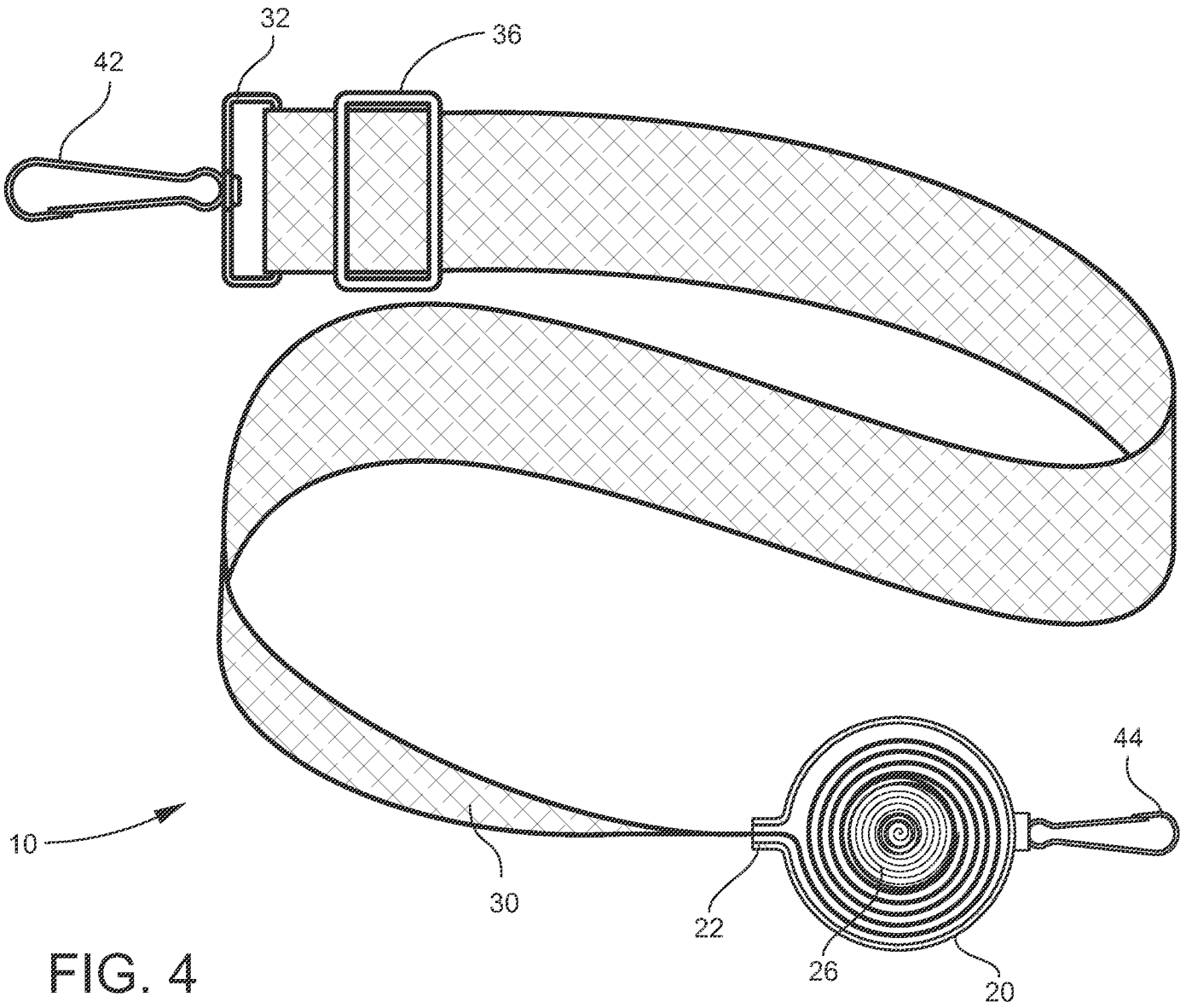
FIG. 4 is a partial cutaway view of an embodiment of the invention showing the strap coiled inside the retractor.

As shown in FIG. 4, the present invention 10 contemplates that the strap 30 may be housed in the retractor 20. The strap 30 enters and exits the retractor 20 at opening 22. A retraction spring 26 biases the strap 30 towards a retracted state where the strap is held inside the retractor 20. When an operator pulls the strap 30 from the retractor 20, the operator is pulling against the spring force of the retraction spring 26.

As shown in FIGS. 5, 6, and 7, the present invention 10 contemplates that a brake 28 may be located in the housing of the retractor 30 to fix the strap 30 in place and counteract the bias of the spring force of the retraction spring 26. The invention contemplates that the brake 28 may operate on the strap 30 in several ways including those shown in FIGS. 6 and 7. The brake 28 may be biased in an open position where the strap 30 may freely retract and extend. When the brake 28 is pressed by an operator, the brake 28 may remain in the braked position until released by the operator. Preferably, once actuated, the brake 28 will remain in the braked position until the operator actuates the release. That is, one press of the brake 28 locks the brake 28. A second press of the brake unlocks the brake 28 and releases the strap 30 to recoil by the force of the retraction spring 26 or to be extended by an operator.

In FIG. 6, the brake 28 comprises a friction brake 60 which utilizes brake pad 62 to apply pressure to the strap 30 inside the retractor 20. When an operator presses brake 28, the friction brake 60 actuates and brake pad 62 contacts the strap 30 thereby preventing the strap from recoiling inside retractor 20 and also preventing the strap 30 from exiting the retractor 20.

In FIG. 7, the brake 28 comprises a ratchet brake 70. The ratchet brake 70 has toothed wheel 74 and ratchet 72. The ratchet 72 is attached to the brake 28 actuator. The toothed wheel 74 is attached to the axle (not shown) which is also attached to the retraction spring 26 and the strap 30. When the brake 28 is actuated, the ratchet 72 will contact the toothed wheel 74 and prevent the rotation of the toothed wheel 74, the axle, and accordingly, the strap 30. The ratchet brake 70 is designed such that when the brake 28 is actuated, it remains in a braked position until an operator releases the brake 28.

Figure 10:
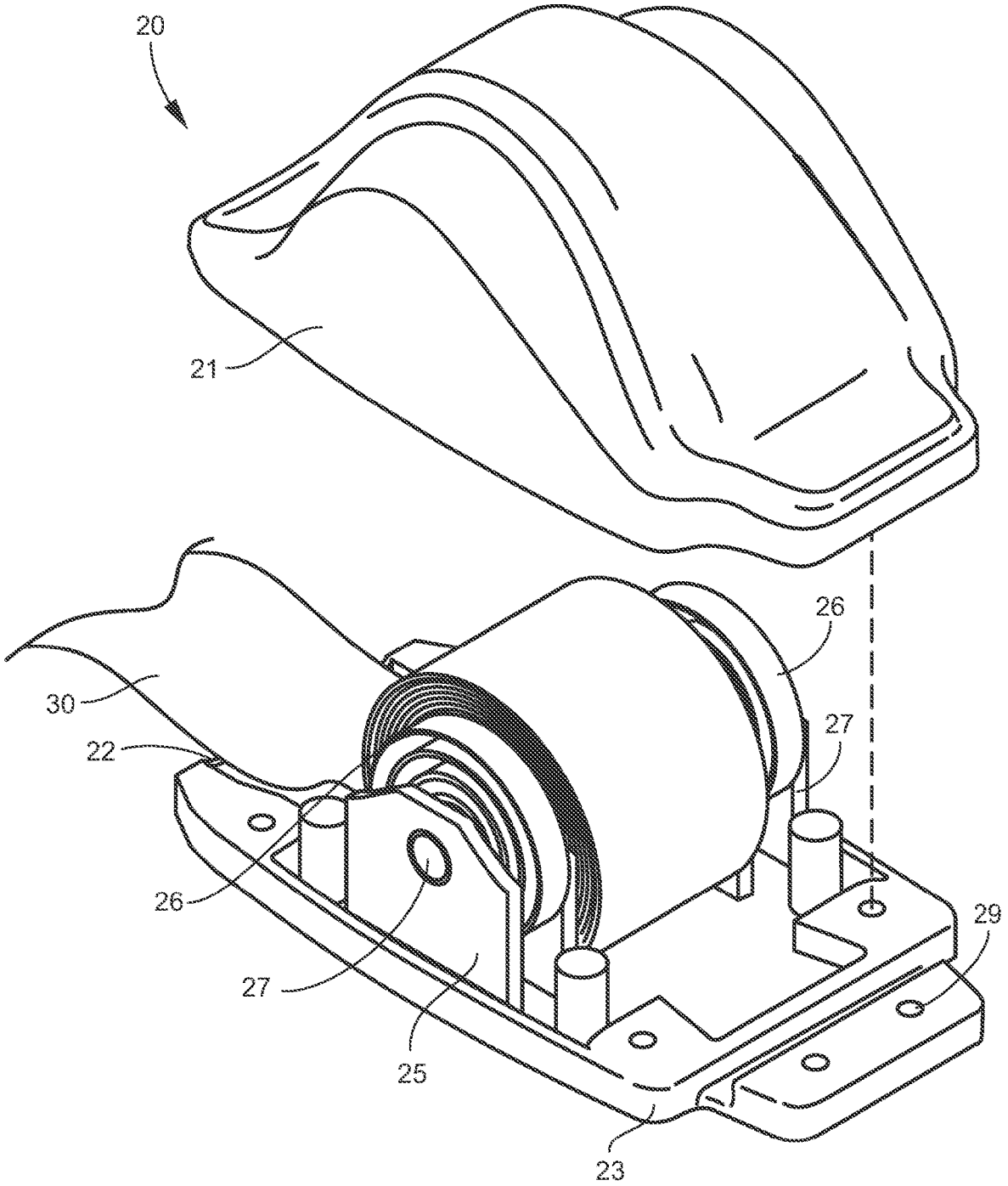
FIG. 10 is an exploded view of an embodiment of the retractor.
Figure 11:
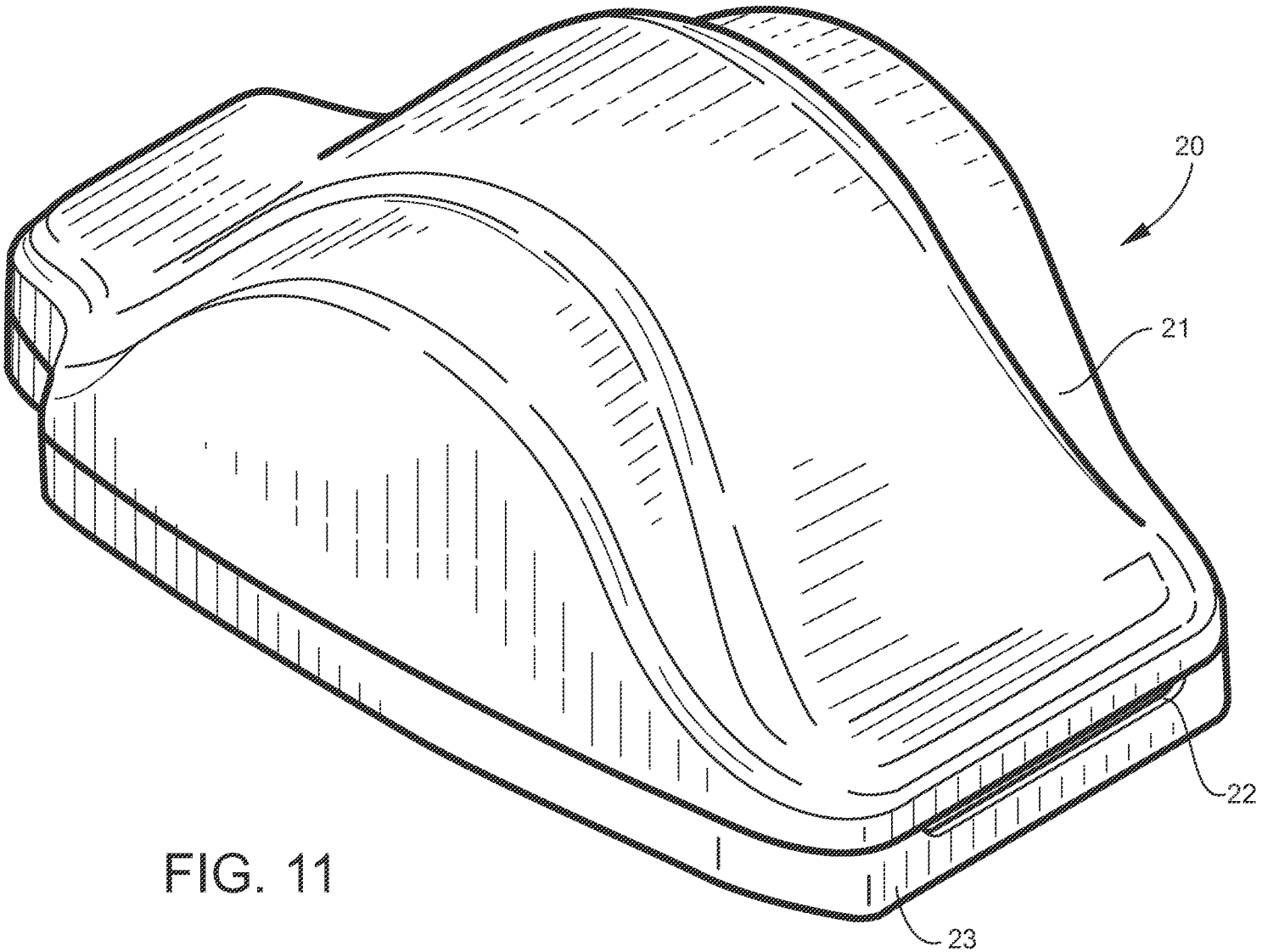
FIG. 11 is a front perspective view of the retractor housing.
Figure 12:
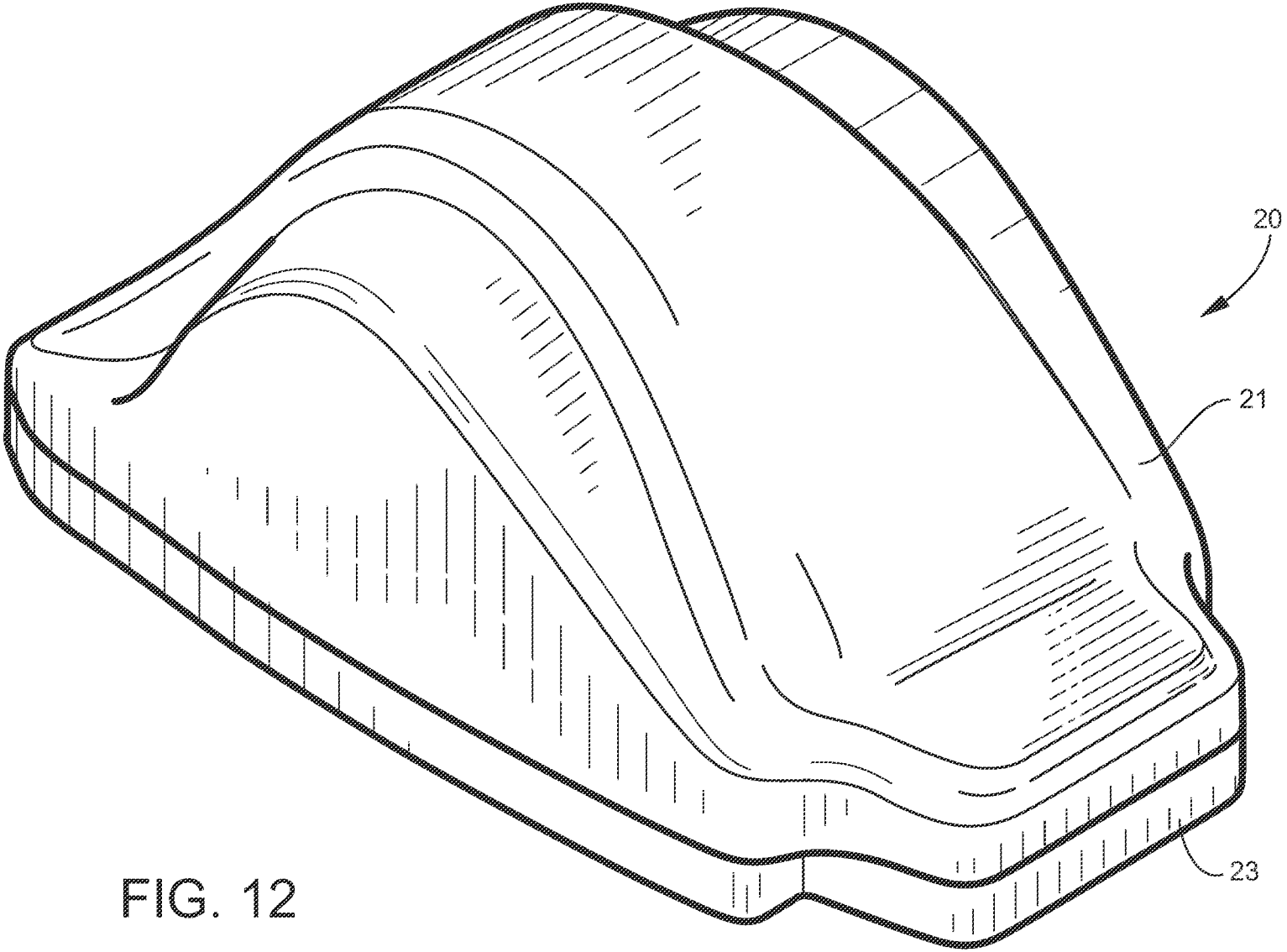
FIG. 12 is a rear perspective view of the retractor housing.
Figure 13:
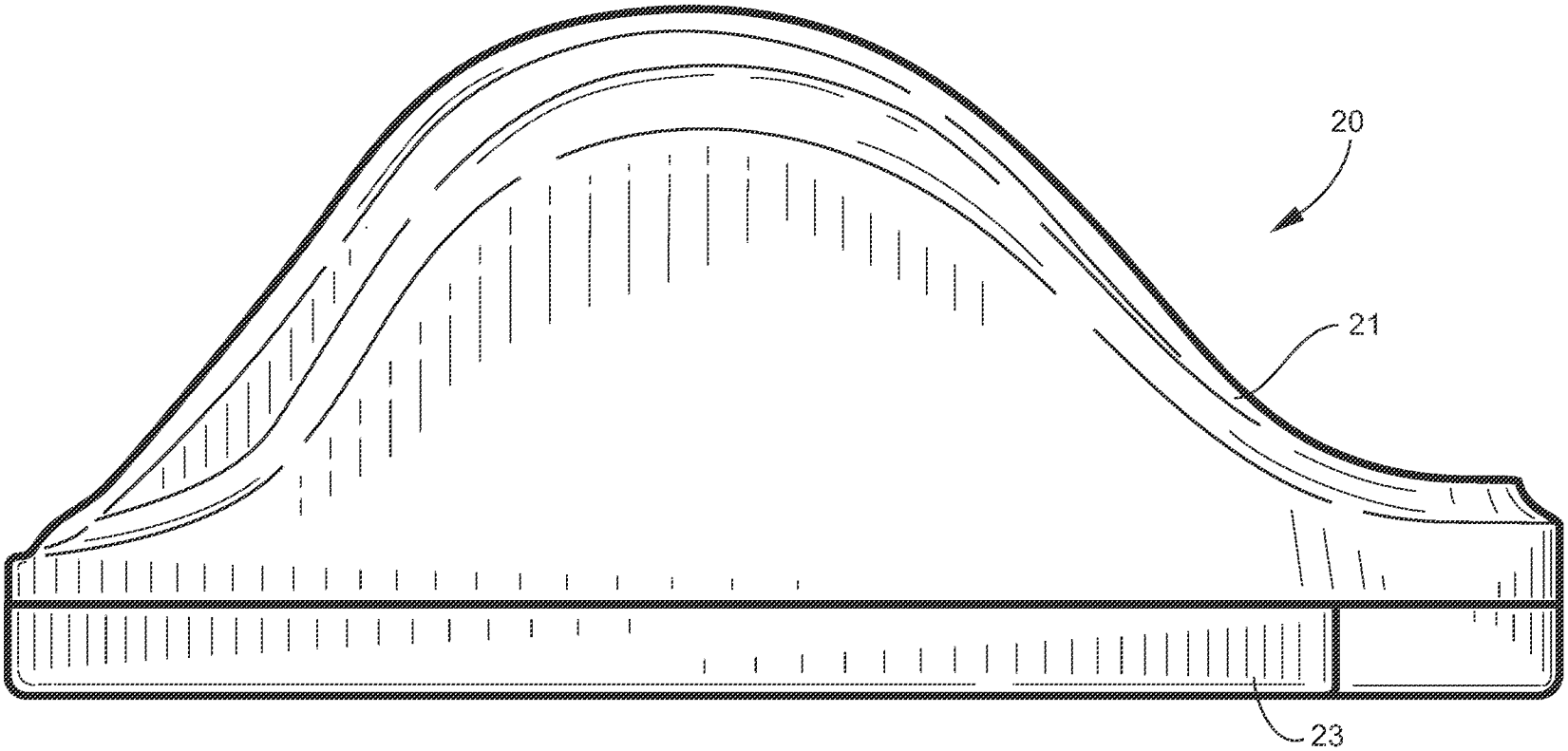
FIG. 13 is a side view of the retractor housing.
Figure 14:
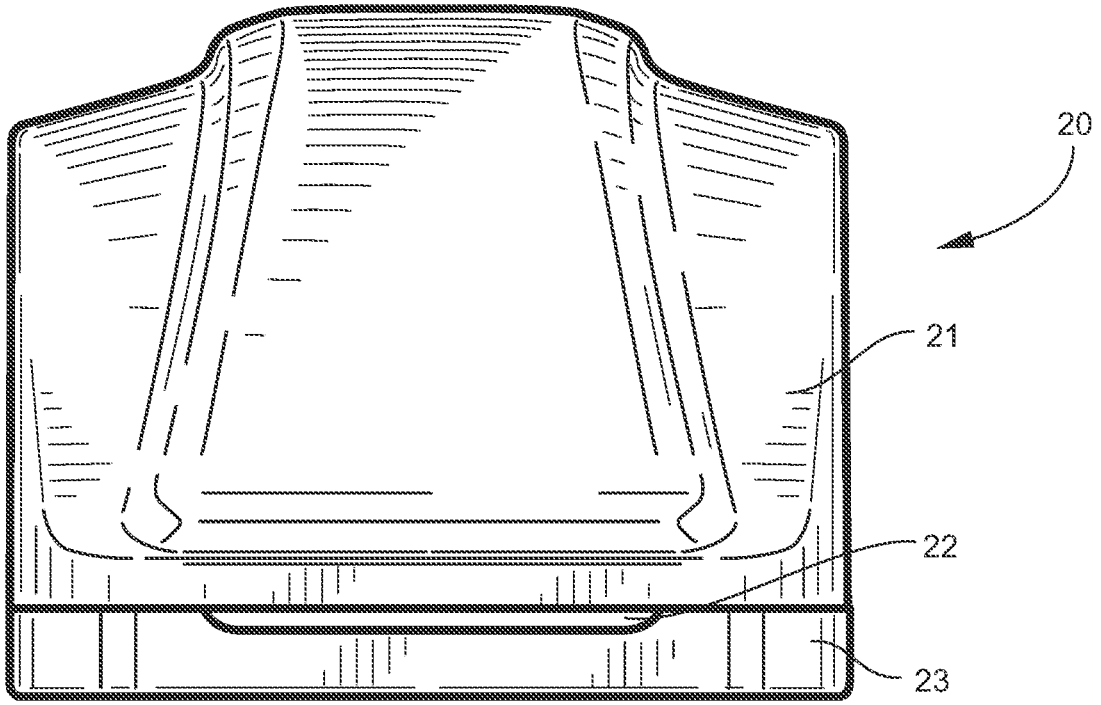
FIG. 14 is a front view of the retractor housing.
Figure 15:
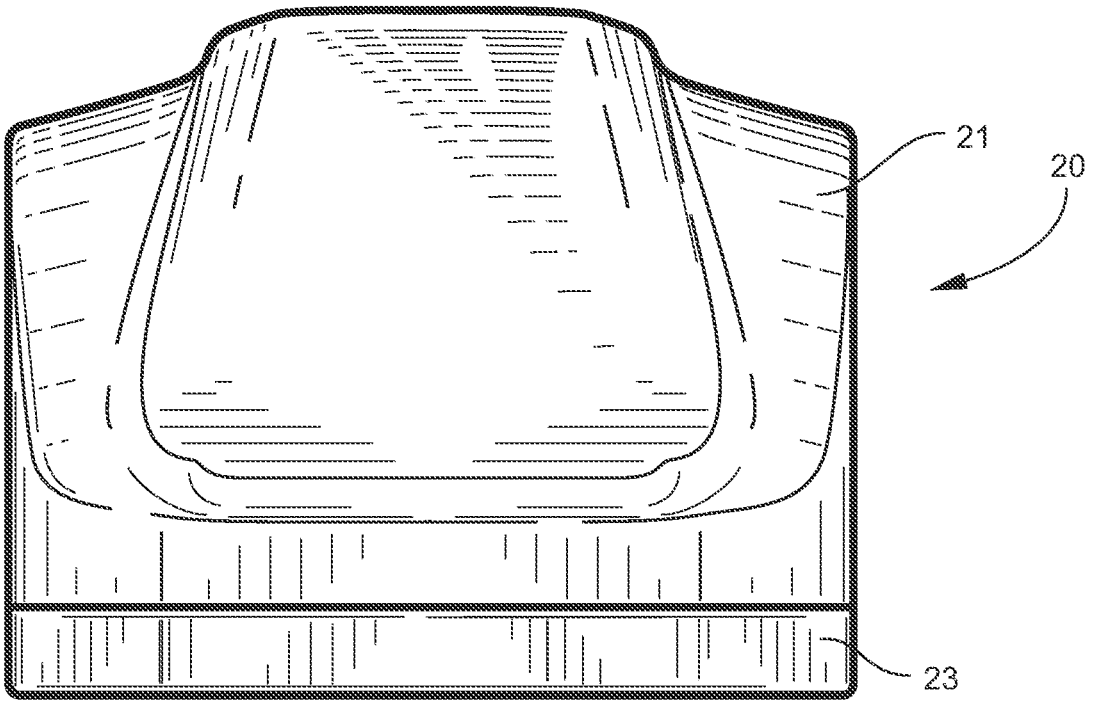
FIG. 15 is a rear view of the retractor housing.
Figure 16:
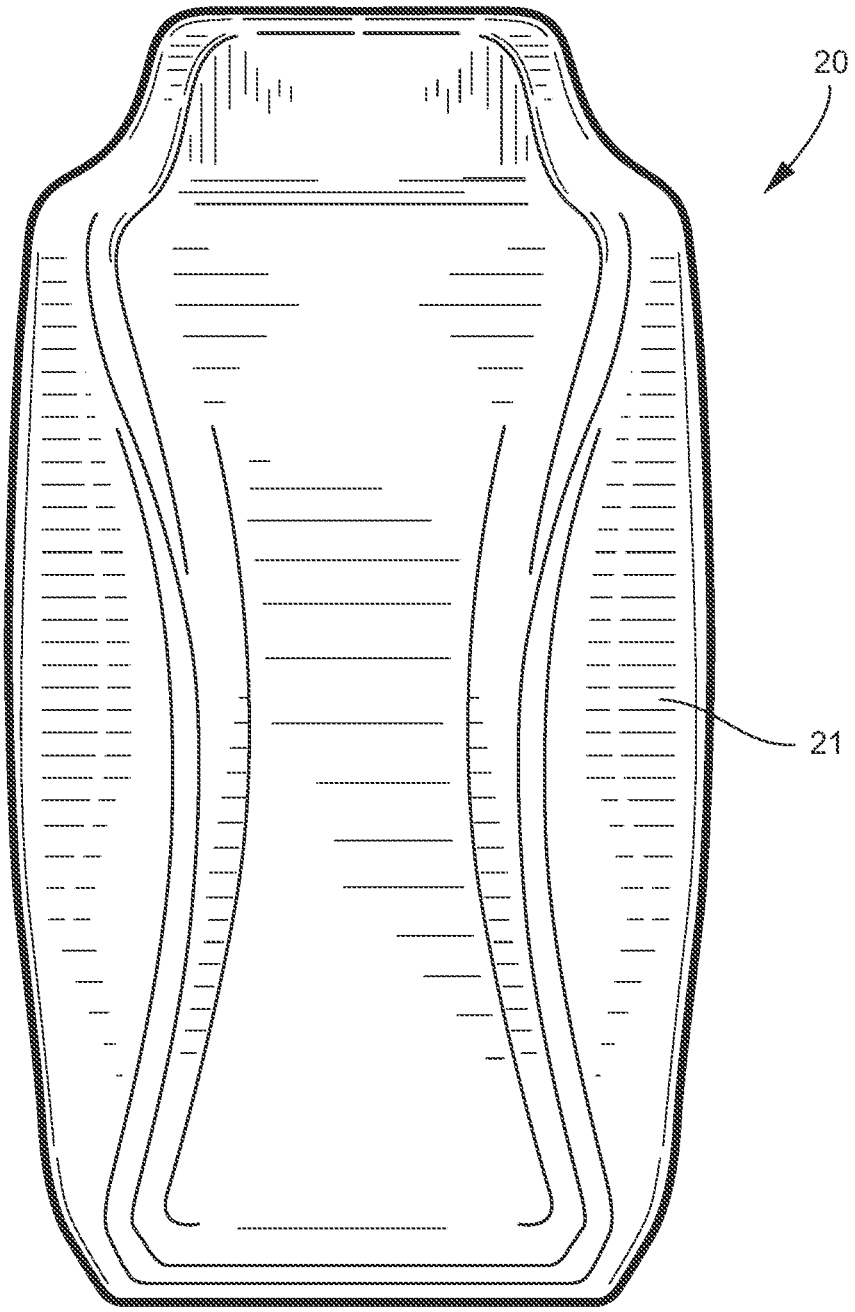
FIG. 16 is a top view of the retractor housing.
Figure 17:
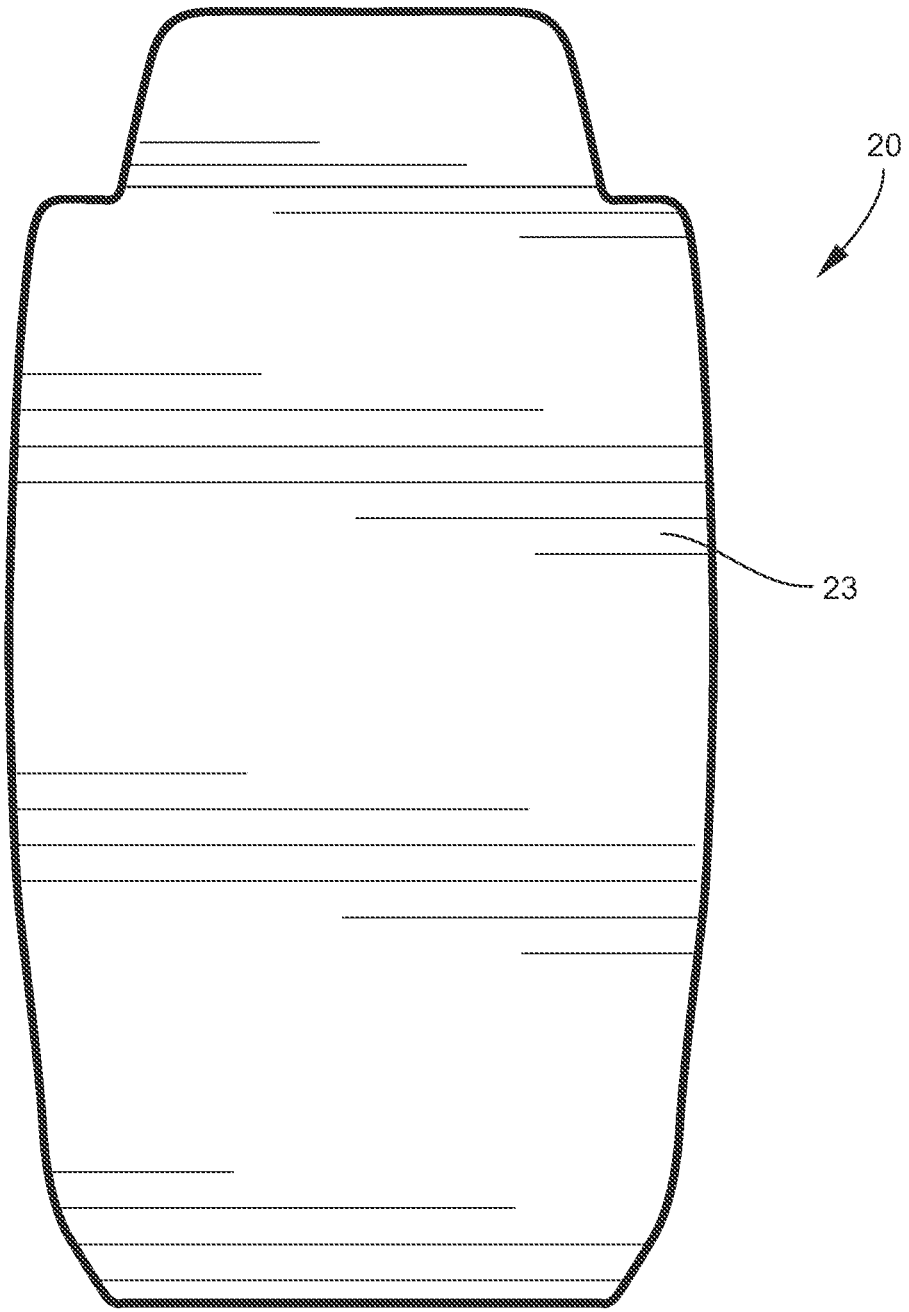
FIG. 17 is a bottom view of the retractor housing.

As shown in FIG. 10, the retractor 20 may, optionally, not include a brake. The retractor may include an upper shell 21 which is removably attached to a base 23. The upper shell 21 may be removably attached to the base 23 via screws (not shown) which pass through holes 29. The base 23 may have a pair of axle supports 25 which support axle 27. The strap 30 is attached to the axle 27 and may wind about the axle 27. The retractor 20 may include a pair of springs 26 disposed at either side of the strap 30 which is wound around an axle 27. The springs 26 operate to bias the strap 30 in the retracted position. The upper shell 21 and/or the base 23 may be made from plastic or metal. The plastic may be molded or 3D printed. FIGS. 11 through 17 highlight the outside of the retractor including the upper shell 21, the base 23, and the opening 22.

An adjustable strap 10 removably attachable to a piece of luggage 50 according to the invention has been described with reference to specific embodiments and examples. Various details of the invention may be changed without departing from the scope of the invention. Furthermore, the foregoing description of the preferred embodiments of the invention and best mode for practicing the invention are provided for the purpose of illustration only and not for the purpose of limitation, the invention being defined by the claims.

What is claimed is:

1. A retractable strap removably attachable to a container comprising:

a retractor having an opening and a retraction spring;

a strip of flexible material attached to the retraction spring and extending through the opening of the retractor;

a second D ring irremovably and directly attached to a distal end of the flexible material; and a clip removably attaching the second D ring to the container;

wherein the strip of flexible material moves from a fully retracted position where the distal end of the strip of flexible material is nearest the retractor relative an entire length of the strip of flexible material to an extended position where the distal end of the strip of flexible material is furthest from the retractor; and wherein, the retraction spring biases the strip of flexible material in the fully retracted position; and wherein, the retractor further comprises a base attached to an upper shell and first D ring irremovably and directly attached to the base and held in place by the upper shell.

2. The retractable strap of claim 1 further comprising a brake.

3. The retractable strap of claim 2 wherein the brake comprises a friction brake.

4. The retractable strap of claim 2 wherein the brake comprises a ratchet brake.

5. The retractable strap of claim 1 further comprising a second clip for attaching the retractor to the container.

6. The retractable strap of claim 1 further comprising a buckle.

* * * * *